US007302883B2

(12) United States Patent
Lynn et al.

(10) Patent No.: US 7,302,883 B2
(45) Date of Patent: Dec. 4, 2007

(54) HYBRID NUTATING PUMP

(76) Inventors: William Harry Lynn, 911 Bayberry La., Kohler, WI (US) 53044; Richard C. Fuksa, 1316 N. Good St., Park Ridge, IL (US) 60068

( * ) Notice: Subject to any disclaimer, the term of this patent is extended or adjusted under 35 U.S.C. 154(b) by 28 days.

(21) Appl. No.: 10/595,005

(22) PCT Filed: Jun. 18, 2004

(86) PCT No.: PCT/US2004/019467

§ 371 (c)(1),
(2), (4) Date: Dec. 7, 2005

(87) PCT Pub. No.: WO2004/113724

PCT Pub. Date: Dec. 29, 2004

(65) Prior Publication Data

US 2007/0022872 A1 Feb. 1, 2007

Related U.S. Application Data

(60) Provisional application No. 60/479,413, filed on Jun. 18, 2003.

(51) Int. Cl.
*F01B 13/04* (2006.01)
*F04B 1/12* (2006.01)

(52) U.S. Cl. ..... 92/12.2; 74/60; 91/499

(58) Field of Classification Search ..... 92/12.2, 92/71; 91/499; 74/60
See application file for complete search history.

(56) References Cited

U.S. PATENT DOCUMENTS

| | | | | |
|---|---|---|---|---|
| 4,934,253 | A | 6/1990 | Berthold et al. | |
| 5,007,385 | A | 4/1991 | Kitaguchi | |
| 5,079,996 | A * | 1/1992 | Abousabha et al. | 92/71 |
| 6,074,174 | A * | 6/2000 | Lynn et al. | 417/269 |
| 6,439,857 | B1 | 8/2002 | Koelzer et al. | |
| 6,450,777 | B2 | 9/2002 | Lynn et al. | |
| 6,866,484 | B2 * | 3/2005 | Reitzig | 417/222.1 |
| 2003/0002990 | A1 | 1/2003 | Reitzig | |

OTHER PUBLICATIONS

International Search Report for International Application Number PCT/US2004/19467, completed on Mar. 14, 2005.

* cited by examiner

*Primary Examiner*—Thomas E. Lazo
(74) *Attorney, Agent, or Firm*—James B. Conte; Barnes & Thornburg LLP

(57) ABSTRACT

A nutating pump has a cross-type universal joint connecting a nutating member to a pump housing, ball joints connecting the nutating member to piston rods, and the piston rods fixed to piston heads so that the piston heads wobble in pump cylinders.

10 Claims, 1 Drawing Sheet

HYBRID NUTATING PUMP

STATEMENT CONCERNING FEDERALLY SPONSORED RESEARCH OR DEVELOPMENT

Not applicable.

FIELD OF THE INVENTION

This invention relates to pumps, and in particular, to nutating pumps.

BACKGROUND OF THE INVENTION

Nutating pumps having a nutating member that has a circular rocking or wobble type of motion to reciprocate pistons so as to result in pumping action are known. For example, U.S. Pat. No. 5,007,385 discloses such a mechanism that uses either a spherical bearing or alternatively a cross-type universal joint between the wobble member and the housing. The wobble member is driven eccentrically by a drive shaft and has arms joined by ball joints or other pivot joints to pistons that reciprocate linearly.

These types of mechanisms have typically had many sliding surfaces and, therefore, many bearings, each making the whole construction relatively complex, difficult to assemble, and expensive.

SUMMARY OF THE INVENTION

The invention provides a nutating pump in which a cross-type universal joint connects the nutating member to the housing, ball joints connect the nutating member to the piston rods, and the piston rods are fixed to the piston heads so that the piston heads wobble in the pump cylinders. This eliminates a bearing connection between the piston rod and the piston head, while achieving the benefits of using a universal joint to connect the nutating member to the housing to take side loads off of the piston heads.

In another aspect of the invention, the piston rods are made relatively long so as to minimize the wobble motion of the piston heads in the pump cylinders. The longer that the piston rods can be made, the less that the piston heads will wobble in the pump cylinders. In other words, for example for a 12° tilt angle of the universal joint, with a sufficiently long piston rod, the piston head will only tilt 1°. Such a low tilt of the piston head from being axially aligned in the pump cylinder allows the use of either a piston cup, as is common in wobble pistons, or of a split-ring seal (a split-ring being of the type that is commonly used in internal combustion reciprocating engines and some reciprocating pumps). Split-ring seals are generally regarded as providing very long wear-life and low blow-by leakage, whereas a wobble piston cup provides adequate sealing with a relatively larger angle of tilt of the wobble piston head.

It is desirable to use a universal joint to connect the nutating member to the housing because the universal joint is capable of carrying the torsional loading to which the wobble member is subjected, reducing side loading on the pistons. Side loading on the pistons results in increased wear, shorter life, and more blow-by leakage over the life of the pump.

In addition, a long stroke which is enabled by the U-joint and also by the use of the socket joints to connect the wobble member to the piston rods provides higher flow in a small space, which is significantly higher than other types of nutating pump designs. Allowing use of split-ring seals instead of piston cups also helps reduce frictional loading and provides better efficiency.

The foregoing and other objects and advantages of the invention will appear in the detailed description which follows. In the description, reference is made to the accompanying drawings which illustrate a preferred embodiment of the invention.

DETAILED DESCRIPTION OF THE PREFERRED EMBODIMENT

Figure 1:
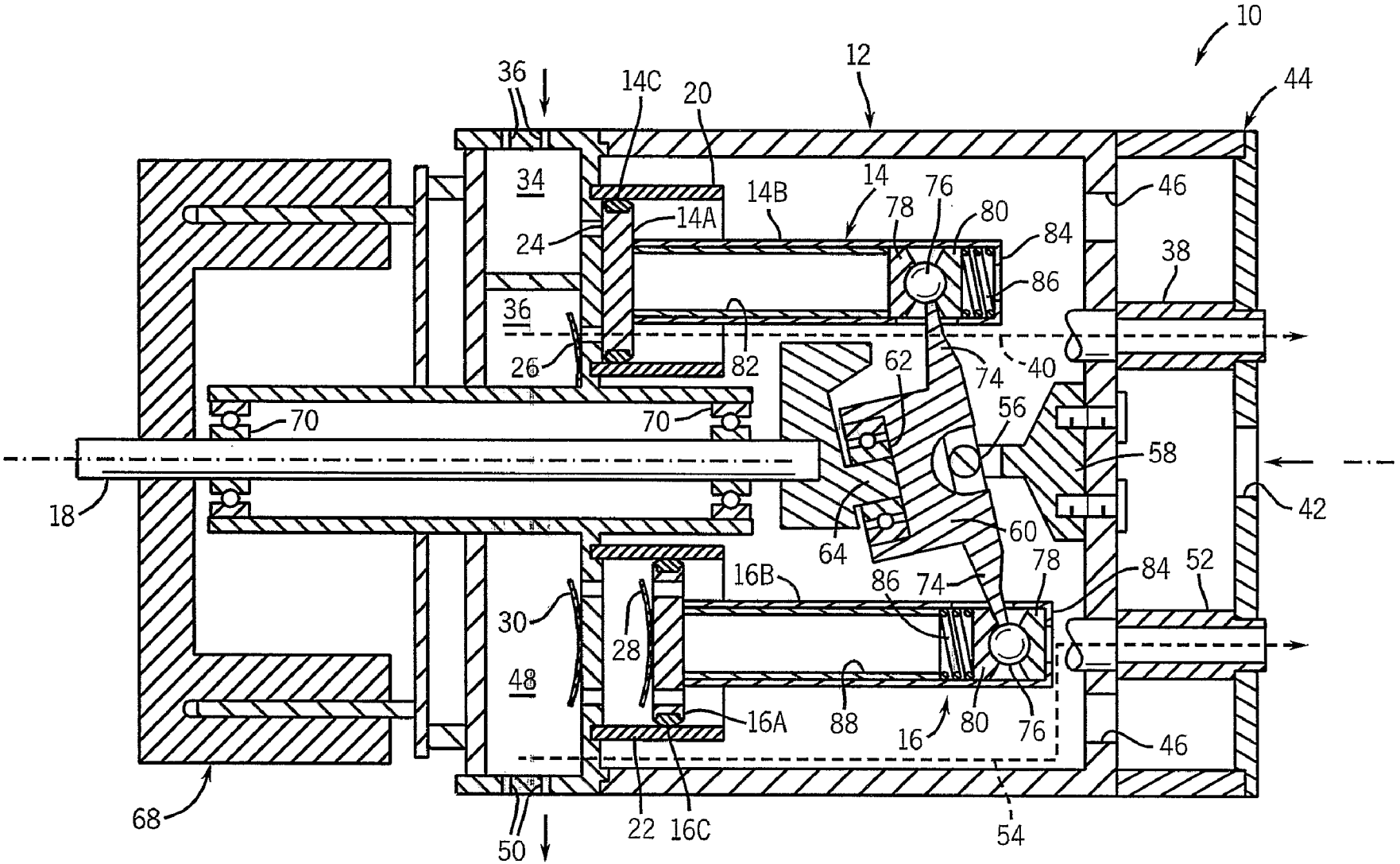
FIG. 1 is a cross-sectional, schematic view taken on a 90° cross-section line illustrating a pump incorporating the invention.

A pump 10 of the invention has a housing 12 which may be made in any number of pieces, a pair of compression pistons 14 opposite from one another (only one shown, the other one would be 180° apart from the one shown, FIG. 1 being a 90° cross-sectional view), a pair of vacuum pistons 16 (only one shown, the other vacuum piston 16 being opposite from the one shown, 180° spaced therefrom about the axis of drive shaft 18). Each piston 14, 16 has a head 14A or 16A and a rod 14B or 16B, respectively. The heads 14A and 16A reciprocate with a slight wobble motion in respective pump cylinders 20 and 22. Heads 14A and 16A have respective split ring seals 14C, 16C, preferably made of a polytetrafluoroethylene composite material, that establish a sliding seal with the walls of the cylinders 20, 22 and are preferably radiused on their outside surfaces with a radius equal to the cylinder radius to maintain good sealing as the piston wobbles in the cylinder. Intake valve 24 and exhaust valve 26 are provided respectively to and from the pumping chamber in cylinder 20 and intake valve 28 and exhaust valve 30 are provided respectively to and from the pumping chamber in the cylinder 22. The invention could also be applied to a pressure-only or a vacuum-only pump, and in that case it would be desirable to provide an odd number of pistons, e.g., three or five, to minimize gas pulsations.

Intake air for cylinder 20 comes into intake chamber 34 through holes 36 and compressed air exits cylinder 20 past valve 26 into exhaust chamber 36 and from exhaust chamber 36 through connector tube 38 which, as indicated by dashed line 40, is in communication with the chamber 36. Intake for the vacuum cylinder 22 comes through hole 42 into sound attenuator housing 44 and through holes 46 into the interior of the housing 12 where it can pass through the piston head 16A past the valve 28 into the pumping chamber of the cylinder 22. Compressed exhaust air from the vacuum cylinder 22 passes by valve 30 into exhaust chamber 48 and out of exhaust chamber 48 either through holes 50 or alternatively through a connector tube 52 that, as illustrated by the dashed line 54 is in communication with the chamber 48. The connector tubes 38 and 52 pass through the attenuator chamber 44 so that all the connections for the pump, including the intake 42 to the vacuum chamber and the exhausts from the pressure and vacuum pumps, can all be provided at the end of the pump. If desired, a connector tube like the tubes 38 and 52 could also be provided for the intake for the pressure cylinder 20.

A cross-type universal joint 56 has two of its opposed arms journalled to connector 58 and the other two of its opposed arms (which are at 90° to the first two opposed arms mentioned) journalled to wobble member 60. "Opposed" as used herein means that the two arms are 180° apart. Wobble member 60 mounts the outer race of a bearing 62 at its end which is opposite from the universal joint 56 and the inner race of the bearing is pressed onto an eccentric stub shaft 64 which is fixed off-center and at an angle to drive shaft 18.

Drive shaft 18 is driven by motor 68 which has its stator fixed to the housing 12 and is journalled by bearings 70 to the housing 12. The center of the universal joint 56 is on the axis of shaft 18. When the shaft 18 is rotated, the universal joint 56 permits the eccentric 64 to impart a wobbling motion to the wobble member 60 such that the two compression pistons 14 (which are 180° relative to each other about the axis of shaft 18) are 180° out of phase with one another and the two vacuum pistons 16, which are at 90° to the compression pistons 14 about the axis of shaft 18 (and which are 180° relative to each other about the axis of shaft 18), are 180° out of phase with one another.

The wobble member 60 has arms 74 which extend from it to the four piston rods 14B and 16B. The arms 74 extend into the respective piston rods and at their ends have ball heads 76. The piston rods 14B and 16B are hollow and contain within them each a fixed socket half 78 and a biased socket half 80. Each fixed socket half 78 of the compressor piston rods 14B is held at a constant spacing from the piston head 14A by a spacer tube 82 which is contained within the rod 14B and the fixed socket half 78 of the vacuum piston rod 16B is held at a fixed spacing from the vacuum piston head 16A by the rod 16B being crimped over at its end 84. Biased socket half 80 of each compression piston rod 14B is biased toward the ball head 76 and toward the piston head 14A by a spring 86 which is held in the rod 14B by the crimp at end 84. The socket half 80 of the vacuum piston 16 is biased against the ball head 76 and away from the piston head 16A by a spring 86, which has its other end acting against a spacer tube 88 inside each piston rod 16B. The springs 86 provide a preload on the ball heads 76 and are not subjected to forces (other than the ones they exert) on the working strokes of the respective pistons. That is because a rigid connection is provided between the ball head 76 and the compressor piston head 14A by the spacer tube 82 and socket half 78 on the power stroke of the compressor piston (i.e. going toward top dead center) and a rigid connection is provided between the ball head 76 and the vacuum piston head 16A on its power stroke (i.e. going toward bottom dead center) by the socket half 78 and the piston rod 16B being crimped over it. Alternatively, the ball and socket joint could be reversed, with the balls on the piston rods 14B, 16B and the sockets on the wobble member 60.

A preferred embodiment of the invention has been described in considerable detail. Many modifications and variations to the preferred embodiment described will be apparent to a person of ordinary skill in the art. For example, split ring seals rather than cup seals could possibly be employed if the the piston rods were made long enough or the wobble of the piston was otherwise reduced to make split ring seals practical. Therefore, the invention should not be limited to the embodiment described.

We claim:

1. A nutating pump comprising:

a pump housing;

a prime mover having a drive shaft with a shaft axis, the drive shaft being driven by the prime mover about the shaft axis relative to the pump housing;

a plurality of pumping cylinders with axes radially disposed about and generally parallel with the shaft axis, said pumping cylinders being fixed relative to the pump housing;

a plurality of wobble pistons, one said wobble piston for each pumping cylinder, each said wobble piston having a piston head and a piston rod fixedly connected to the piston head, each said piston head being received in the associated pumping cylinders in a fit that permits wobbling motion of the piston head relative to the pumping cylinder as the piston is reciprocated;

a wobble member connected to the piston rods; and a universal joint connecting the wobble member to the housing.

2. A nutating pump as claimed in claim 1, wherein the wobble member is connected to the piston rods with a ball and socket joint.

3. A nutating pump as claimed in claim 1, wherein each piston head has a cup seal that forms a sliding seal with the associated pumping cylinder.

4. A nutating pump comprising:

a pump housing;

a prime mover having a drive shaft with a shaft axis, the drive shaft being driven by the prime mover about the shaft axis relative to the pump housing;

a plurality of pumping cylinders with axes radially disposed about and generally parallel with the shaft axis, said pumping cylinders being fixed relative to the pump housing;

a plurality of wobble pistons, one said wobble piston for each pumping cylinder, each said wobble piston having a piston head and a piston rod fixedly connected to the piston head, each said piston head being received in the associated pumping cylinders in a fit that permits wobbling motion of the piston head relative to the pumping cylinder as the piston is reciprocated;

a wobble member connected to the piston rods with a ball and socket joint; and a universal joint connecting the wobble member to the housing, wherein each ball and socket joint includes a fixed member and a biased member.

5. A nutating pump as claimed in claim 4, wherein the fixed members transmit a force of pumping between the wobble member and the wobble pistons during a power stroke of the wobble piston.

6. A nutating pump as claimed in claim 4, wherein the wobble member is positioned axially between the fixed member and the head of the wobble piston for vacuum pistons of the pump.

7. A nutating pump comprising:

a pump housing;

a prime mover having a drive shaft with a shaft axis, the drive shaft being driven by the prime mover about the shaft axis relative to the pump housing;

a plurality of pumping cylinders with axes radially disposed about and generally parallel with the shaft axis, said pumping cylinders being fixed relative to the pump housing;

a plurality of wobble pistons, one said wobble piston for each pumping cylinder, each said wobble piston having a piston head and a piston rod fixedly connected to the piston head, each said piston head being received in the associated pumping cylinders in a fit that permits wobbling motion of the piston head relative to the pumping cylinder as the piston is reciprocated;

a wobble member connected to the piston rods; and a universal joint connecting the wobble member to the housing wherein piston rods of the wobble pistons are hollow.

8. A nutating pump as claimed in claim 7, wherein the piston rods contain the a ball and socket joint.

9. A nutating pump as claimed in claim 8, wherein the piston rods contain springs that bias parts of the ball and socket joints together.

10. A nutating pump comprising:

a pump housing;

a prime mover having a drive shaft with a shaft axis, the drive shaft being driven by the prime mover about the shaft axis relative to the pump housing;

a plurality of pumping cylinders with axes radially disposed about and generally parallel with the shaft axis, said pumping cylinders being fixed relative to the pump housing;

a plurality of wobble pistons, one said wobble piston for each pumping cylinder, each said wobble piston having a piston head and a piston rod fixedly connected to the piston head, each said piston head being received in the associated pumping cylinders in a fit that permits wobbling motion of the piston head relative to the pumping cylinder as the piston is reciprocated;

a wobble member connected to the piston rods; and a universal joint connecting the wobble member to the housing wherein each piston rod is longer than the distance from the axis of the drive shaft to an axis of a cylinder associated with the piston rod.

* * * * *